US005104250A

United States Patent [19]

Pacione

[11] Patent Number: 5,104,250

[45] Date of Patent: Apr. 14, 1992

[54] TWO-PIECE FOLDER

[76] Inventor: Peter L. Pacione, 755 The Queensway E., Mississauga, Ontario, Canada, L4Y 4C5

[21] Appl. No.: 674,187

[22] Filed: Mar. 25, 1991

[30] Foreign Application Priority Data

Apr. 24, 1990 [CA] Canada ..... 2015286

[51] Int. Cl.[5] ..... B42F 13/00

[52] U.S. Cl. ..... 402/75; 402/73; 206/576

[58] Field of Search ..... 402/73, 75; 206/223, 206/576, 232; 229/1.5 R

[56] References Cited

U.S. PATENT DOCUMENTS

| | | | |
|---|---|---|---|
| 981,366 | 1/1911 | Boyce . | |
| 3,516,599 | 6/1970 | Buttery | 229/72 |
| 3,643,363 | 2/1972 | Biro | 281/45 |
| 3,933,294 | 1/1976 | Meenan | 229/1.5 |
| 4,262,838 | 4/1981 | MacKenzie | 229/72 |
| 4,477,013 | 10/1984 | Herrin | 229/1.5 |
| 4,758,022 | 7/1988 | Podosek et al. | 229/1.5 R X |
| 4,764,159 | 8/1988 | Mitsuyama | 493/189 |
| 5,025,978 | 6/1991 | Pacione | 229/1.5 R |

FOREIGN PATENT DOCUMENTS

| | | | |
|---|---|---|---|
| 494596 | 3/1930 | Fed. Rep. of Germany | 40/359 |
| 3027919 | 2/1981 | Fed. Rep. of Germany . | |
| 912579 | 8/1946 | France | 229/1.4 R |

*Primary Examiner*—Timothy V. Eley
*Assistant Examiner*—Willmon Fridie, Jr.
*Attorney, Agent, or Firm*—Riches, McKenzie & Herbert

[57] ABSTRACT

The present invention provides a kit for a portfolio folder which is readily adapted to be purchased by a small photocopy or printing center. The front panel of the kit is sized to become comparable to that of normal paper sizes and readily adapted to have printed material applied to at least one side thereof by use of standard sized photographic or offset printing equipment. After application of indicia or printed matter to the front panel, the components of the kit are then assembled by securing the front panel to the rear panel. The kit may also include a binding apparatus for securing to either the front or rear panel for retaining sheet material in the assembled portfolio folder. The kit and method in accordance with the present invention permit small quantities of folders to be provided with customized printing on the front panel at relatively low cost.

34 Claims, 5 Drawing Sheets

TWO-PIECE FOLDER

RELATED APPLICATION

This application is a continuation in part to copending U.S. patent application 519,770 filed May 7, 1990, now U.S. Pat. No. 5,025,978.

SCOPE OF THE INVENTION

This invention relates to paperboard folders and, more particularly, to a kit for paperboard folders which permits custom photocopying or other printing of small quantities of folders on a cover panel.

BACKGROUND OF THE INVENTION

Many folders are known which have a one-piece construction formed to have a front panel, a rear panel and a pocket at a lower front portion of the rear panel. It is also known to include as part of the folder, a binding apparatus for retaining sheet material, either permanently or releasably, in the folder between the front panel and rear panel. Such portfolio folders are useful as, for example, to contain information and promotional materials which are desired to be presented to others in a pleasing, convenient format. Known folders are frequently constructed of light cardboard and bristol board.

It is desirable to provide printed material on the exterior of the front and/or rear panels. Previously known one-piece file folders have a major disadvantage that to print material on the one-piece paperboard blank to form the folder requires both die cutting equipment and a printing press of substantial size. This requires increased costs and, in particular, substantial costs for the plates to print the large one-piece blank. Such prior art one-piece folders are, therefore, expensive to print except when printing large quantities.

Disadvantages of known one-piece folders are that a few folders cannot be printed except at generally prohibited cost and, as well, require a considerable turnaround time for delivery.

One piece binders, such as three ring binders are known which have rings to removably retain paper between front and rear panels of the binders. Such binders also suffer the disadvantage that front covers of the binders can not be custom printed in small numbers at a low cost.

SUMMARY OF THE INVENTION

To at least partially overcome these disadvantages of known one-piece folders, the present invention provides a two-piece folder with a separate front panel which can readily be photocopied or printed in a small offset printing press or facility.

In one of its objects, the present invention provides a two-piece paperboard folder whose front panel can readily be photocopied or printed in a small offset printing press or facility.

Another object is to provide a kit for a folder which comprises two panels with the rest panel carrying preformed pocket means and means to secure the front panel to the rear panel.

Another object is to provide a kit for a portfolio folder which comprises two panels and a binding apparatus, means to secure the front panel to the rear panel, and means to secure the binding apparatus to either the front panel or the rear panel.

Another object is to provide a method for printing and assembly of a file folder from a file folder kit having separate front and rear panels.

The present invention provides a two-piece kit for a portfolio folder which is readily adapted to be purchased by a photocopy or printing center. The front panel of the kit is sized to become comparable to that of normal paper sizes and readily adapted to have printed material applied to at least one side thereof by use of standard sized photographic or offset printing equipment. The front panel of the kit may be for example paper board of 10 point to 20 point weight, coasted paper products, vinyl sheets, plastic paper being paper covered with a plastic or other suitable material. After application of indicia or printed matter to the front panel, the components of the kit are then assembled by securing the front panel to the rear panel.

The kit and method in accordance with the present invention permit small quantities of folders to be provided with customized printing on the front panel at relatively low cost and quick turnaround. The kits may be provided with devises to retain papers in the folders. A pocket may be provided or one surface of either the front or rear panel. Binding apparatus such as including known three ring or spiked paper holding devices may be provided on the front or rear panel, preferably provided as a separate element of the kit. When a binding apparatus is to be included, the assembled folder preferably has a spine of sufficient thickness accommodate the binding apparatus and any paper to be returned between the front and rear panels.

Preferably one of the front and rear panels carry an adhesive strip covered by a release sheet for removal to permit easy assembly by adhering flaps on one panel to the other panel in overlapping manner, with suitable hinge forming fold lines providing a hinge for the resultant folder and/or spines of desired depth.

In a first aspect, the present invention provides a kit for assembly into a portfolio folder comprising a separate front panel having an outer surface suitable for photocopying or offset printing; a separate rear panel; binding means for retaining sheet material in an assembled portfolio folder between the front panel and the rear panel; adhesive means comprising a thin strip having a layer of adhesive on each side thereof for securing the rear panel to the front panel, said rear panel comprising a rectangular sheet having a thin elongate flap portion along one side edge thereof delineated from a remaining rectangular portion of the rear panel by a hinge-forming scoreline parallel to said one side edge, said front panel comprising a rectangular sheet of dimensions substantially the same as that of said remaining rectangular portion, said rear panel adapted to be secured to said front panel with said flap portion folded along said scoreline and said flap portion overlying a thin elongate side portion of said front panel along a side edge thereof, said adhesive means secured to said flap portion by means of one of said layers of adhesive, the other layer of adhesive removably receiving a removable release sheet and enabled, when said release sheet is removed, to adhere to the side portion.

In a second aspect, the present invention provides a kit for assembly into a portfolio folder comprising a separate first panel; a separate second panel; binding means for retaining sheet material in an assembled portfolio folder between the first panel and the second panel; first adhesive means for securing the first panel to the second panel, second means for securing the binding means to one of the first panel and the second panel, said first panel comprising a rectangular sheet having a thin elongate first flap portion along one side edge thereof delineated from a remaining rectangular portion of the first panel by a hinge-forming first scoreline parallel to said one side edge, said second panel comprising a rectangular sheet having a thin elongate second flap portion along one side edge thereof delineated from a remaining rectangular portion of the second panel by a hinge-forming second scoreline parallel to said one side edge, said remaining rectangular portion of the second panel having dimensions substantially the same as that of said remaining rectangular portion of the first panel, said first panel adapted to be secured to said second panel by the first adhesive means with said first flap portion folded along said first scoreline, said second flap portion folded along said second scoreline, and said first flap portion overlying said second flap portion, said first adhesive means secured to a first side of one of said first flap portion and said second flap portion, said first adhesive means having a removable release sheet for removal to activate the first adhesive means for adhesion to a first side of the other of the first flap portion and the second flap portion.

In a third aspect, the present invention provides A kit for assembly into a portfolio folder comprising a separate first panel; a separate second panel; binding means for retaining sheet material in an assembled portfolio folder between the first panel and the second panel; first adhesive means for securing the first panel to the second panel, second means for securing the binding means to one of the first panel and the second panel, said first panel comprising a rectangular sheet having a thin elongate first flap portion along one side edge thereof, a thin elongate second flap portion adjacent the first flap portion, and a remaining rectangular portion, said first flap portion delineated from the second flap portion by a hinge-forming first scoreline parallel to said one side edge, and said second flap portion delineated from the remaining rectangular portion by a hinge-forming second scoreline parallel to said one side edge, said second panel comprising a rectangular sheet of dimensions substantially the same as that of said remaining rectangular portion of the first panel, said first panel adapted to be secured by the first adhesive means to said second panel with said first flap portion folded along said first scoreline, said second flap portion folded along said second scoreline and, said first flap portion overlying a thin elongate side portion of said second panel along a side edge thereof, said first adhesive means secured to one of said first flap portion and side portion, said first adhesive means having a removable release sheet for removal to activate the first adhesive means for adhesion to the other of said first flap portion and side portion.

In a fourth aspect, the present invention provides a method of manufacture of portfolio folders from a kit in accordance with the first, second and third preferred aspects comprising applying printed material to a front face of the first panel and thereafter securing first and second panels together.

BRIEF DESCRIPTION OF THE DRAWINGS

Further aspects and advantages of the present invention will appear from the following description taken together with the accompanying drawings in which.

DETAILED DESCRIPTION OF THE DRAWINGS

Figure 1:
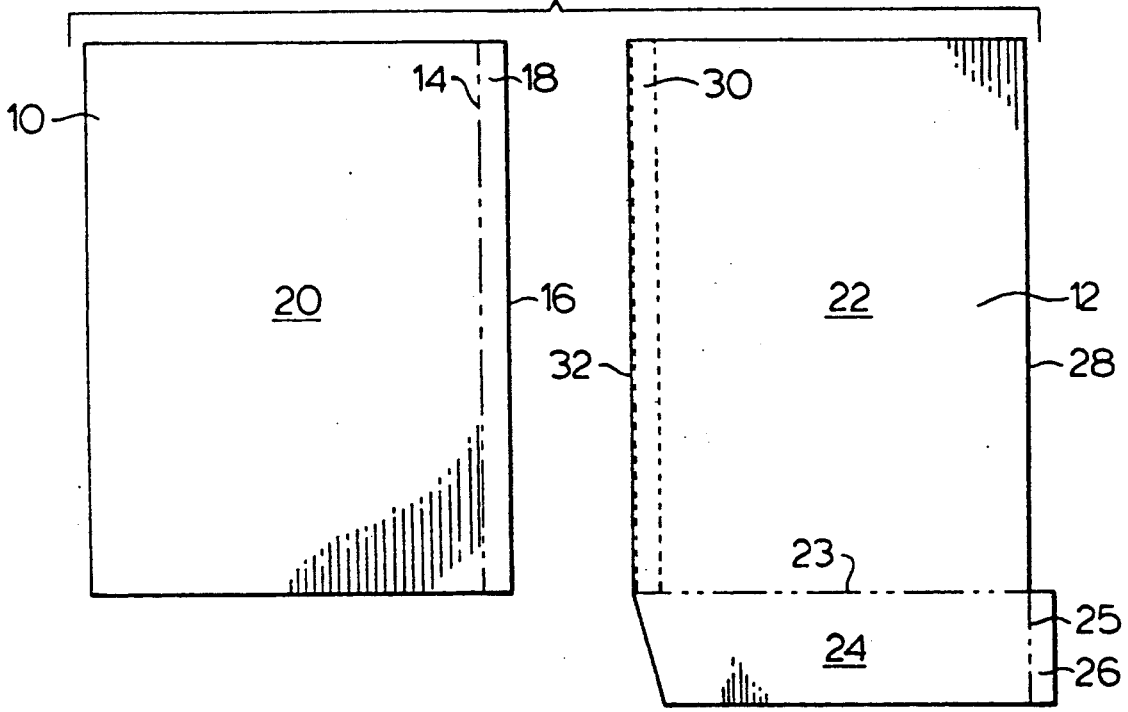
FIG. 1 is a plan view showing a front and rear panels of a kit in accordance with a first embodiment.
Figure 2:
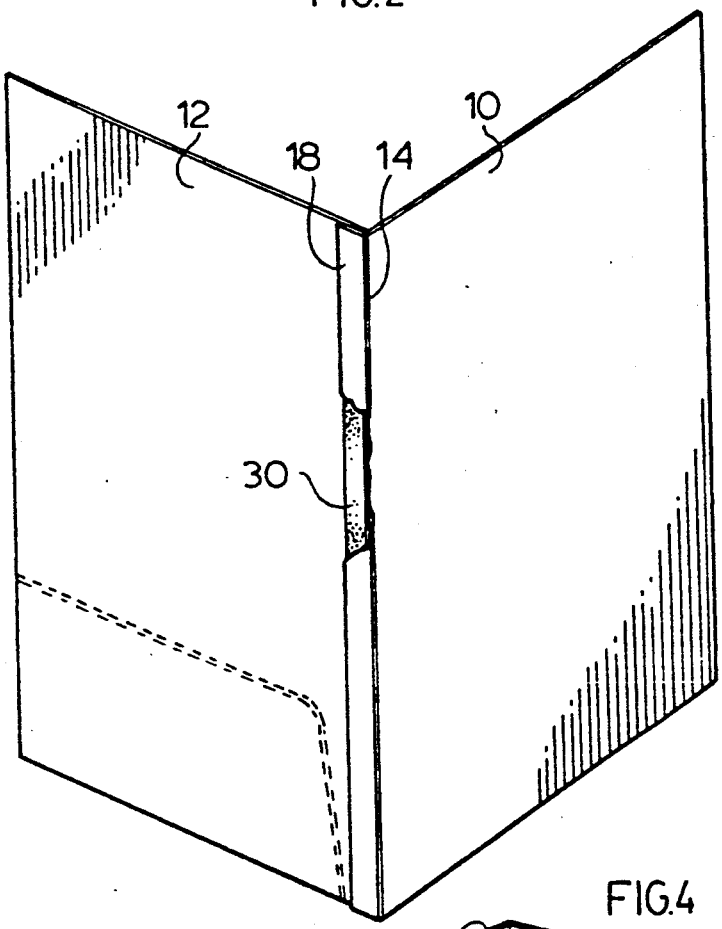
FIG. 2 shows the kit of the first embodiment of FIG. 1 assembled.

Reference is made first to FIGS. 1 and 2 showing a kit in accordance with a first embodiment. The kit comprises a separate front panel 10 and a separate rear panel 12.

Front panel 12 comprises a rectangular sheet of paperboard having a hinge-forming scoreline 14 near one side edge 16 so as to define a thin elongate flap portion 18 between the scoreline 14 and the side edge 16 and a remaining rectangular portion 20 comprising the rest of the front panel other than flap portion 18.

Rear panel 12 comprises a planar sheet of paperboard of irregular shape having two scorelines 23 and 25 which serve to delineate the rear panel into a rectangular, major portion 22, pocket portion 24 and pocket flap 26. The rear panel is preassembled to form a pocket by having pocket flap 26 folded along scoreline 25 over pocket portion 24 and then pocket portion 24 folded along scoreline 23 to lie on top of the front face of major portion 22. Pocket flap 26 may be permanently secured as by adhesive to major portion 22 as along its lower side edge 28.

Rear panel 12 carries an adhesive strip generally indicated 30 on the rear surface of panel 12 adjacent its side edge 32.

Figure 3:
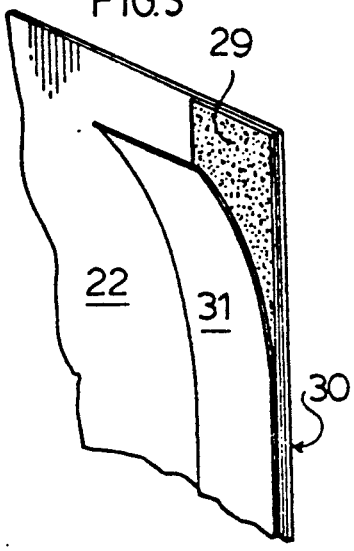
FIG. 3 shows an enlarged view of an adhesive strip of FIGS. 1 and 2.

As seen in FIG. 3, the adhesive strip 30 comprises a elongate strip of adhesive material 29 permanently secured on its undersigned to major portion 22 and having a release strip 31 covering its entire length. With the release strip 31 removed, the adhesive strip 30 is then activated and able to engage and permanently secure to flap portion 18. A preferred strip is sold by Fasson Canada Inc. under the trade mark DUBLSTIK TAPE.

As seen in FIG. 2, the front panel and rear panel of the kit of FIG. 1 have been assembled by placing the front surface of flap portion 18 of the front panel 10 over the rear of major portion 22 of rear panel 12 so that the inside surface of the flap portion 18 is engaged by the activated adhesive strip 30 thereby permanently securing the front panel to the rear panel with the scoreline 14 aligned to be parallel to the side edge 32 of rear panel 12. As assembled, the kit provides a file folder with a convenient pocket 29 into which paper sheets can be placed and then protected by the front panel folded along scoreline 14 to overlie the rear panel. As shown in FIG. 2, the flap portion 18 overlies a thin elongate side portion of said major portion 22 along side edge 32 of major portion 22 and it is to be appreciated that the adhesive strip is applied to this side portion of the rear panel.

In use of the kit of FIG. 1, the kit is preferably provided with the rear panel assembled so that the pocket is pre-formed.

Front panel 10 comprises a thin sheet of material which may readily have printed material applied thereto. For example, the front panel 10 may be of a size and of a material composition which readily permits application of printed material as by passing the same through a conventional photocopier. Similarly, the front panel 10 may be of a size and of a composition to facilitate easy printing of the material thereon by a small-sized offset printer. Such small-sized photographic machines and small-sized offset printers are readily available in, for example, small printing houses. The front panel 10 may be preferably sized, for example, to have its rectangular portion 20 of a conventional paper size such as 8½ inches by 11 inches, 8½ inches by 14 inches and the like, with its flap portion 18 to have a width of, for example ½ inch.

With the front panel not carrying either the adhesive strip or the pocket as seen in FIGS. 1 and 2, the front panel comprises a relatively simple flat planar sheet preferably of paperboard or bristol board which can easily be handled for printing.

In use of the invention in accordance with the present invention, the kit is preferably supplied with the rear panel carrying the pocket and adhesive means and the front panel being a simple flat sheet readily adapted for photocopying or printing. Prior to assembly, the front panel may be easily printed and thereafter the kit assembled. Thus, only a small number of front panels need to be printed as is advantageous to meet customized needs of small customers.

While the preferred embodiment of FIG. 1 shows the adhesive strip 30 on the rear surface of rear panel 12, the adhesive strip could alternately be provided on the front surface of rear panel 12, to engage the outside surface of flap portion 18. While less preferred, the adhesive strip could be provided on flap portion 18 as seen in FIG. 1, and on either side thereof although providing the strip 30 on the inside would be preferable to result in a folder to appear assembled as in FIG. 2.

Figure 4:
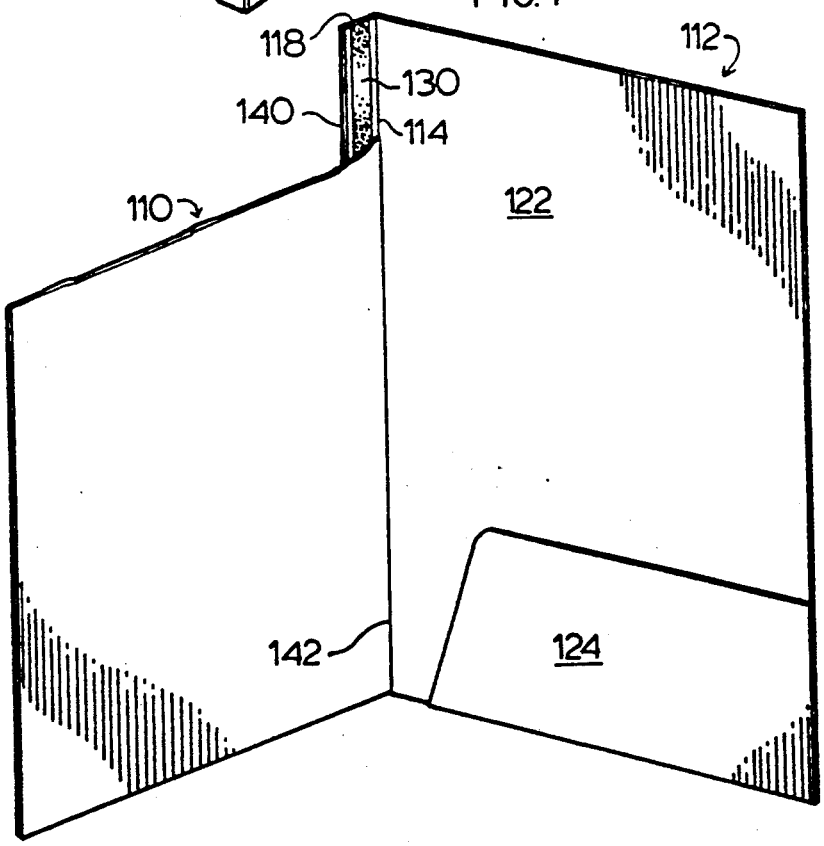
FIG. 4 shows the kit of a second embodiment assembled.

Reference is now made to FIG. 4 which shows a second embodiment of a kit in accordance with the present invention. Front panel 110 comprises a simple sheet of planar material which is adapted for photocopying or offset printing. Rear panel 112 has a scoreline 114 running along the length of one side edge 140 thereof so as to define an elongate flap 118 on one side of the scoreline and a major rectangular portion 122 on the other side. The major rectangular portion 122 carries a pocket 124. Adhesive strip 130 is applied to the front of flap portion 118 with the adhesive strip having had a removable release sheet on the upper surface thereof similar to that in FIG. 3.

In use of the kit, the front panel 110 may have printed material applied thereto by photocopying or offset printing and thereafter with the release sheet removed from the strip, the front panel may be secured to the rear panel by the front panel being placed with side edge 142 aligned with scoreline 114 so that the flap portion 118 overlies a thin elongate side portion of the front panel 110 adjacent side edge 142.

As with the first embodiment, the adhesive strip 130 may be applied to either surface of flap 118 or cover 110 adjacent its side edge 142. Preferably, however, strip 130 is on the rear panel 112.

Figure 5:
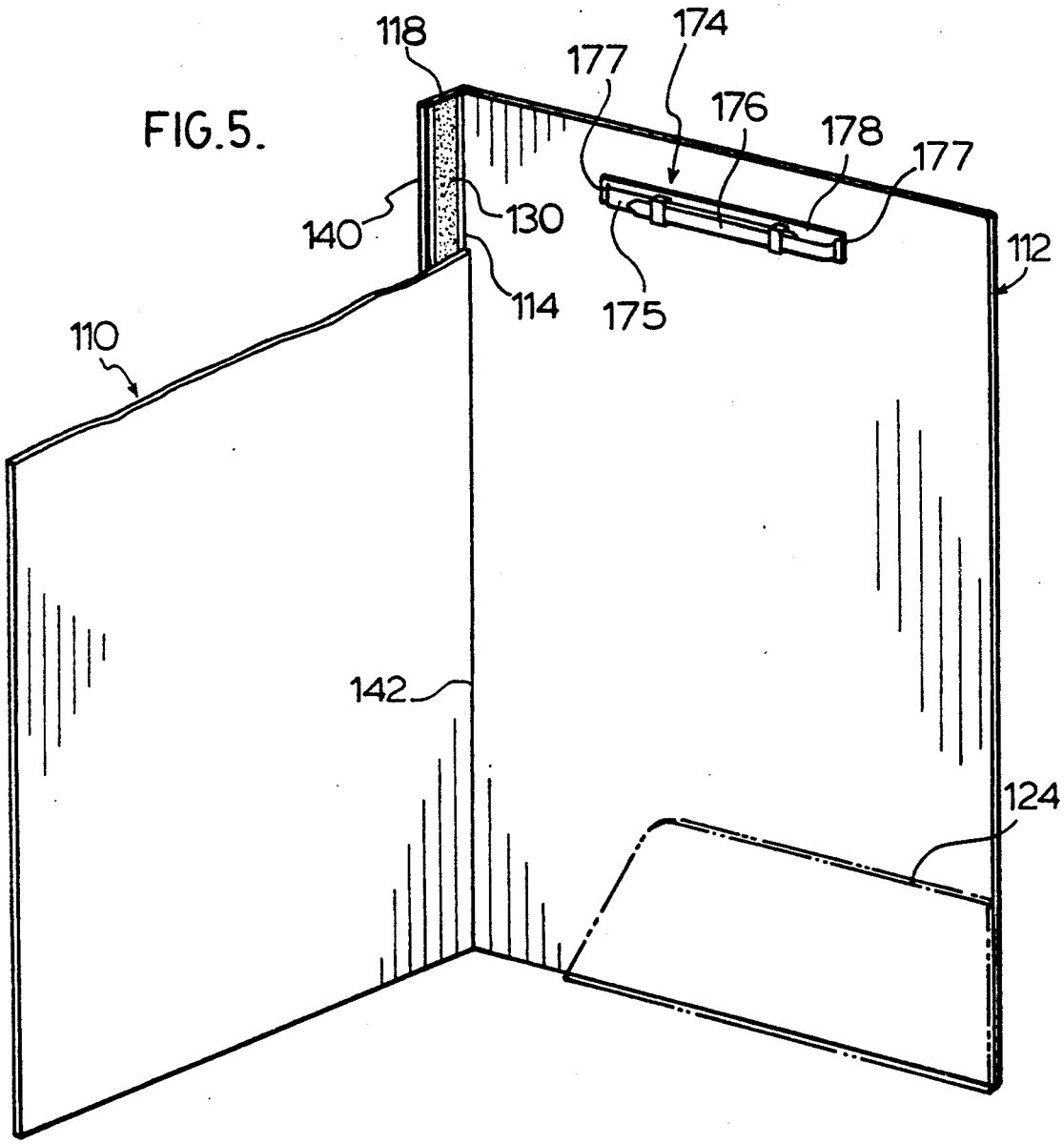
FIG. 5 shows the kit of a third embodiment assembled.

FIG. 5 shows a kit in accordance with the third embodiment which is the same in many aspects as the second embodiment of FIG. 4, and accordingly similar reference numerals show equivalent elements to those in FIG. 4. FIG. 5 differs from FIG. 4 in two aspects. Firstly, major rectangular portion 122 carries a binding apparatus 174 for releasably or permanently retaining sheet material in an assembled portfolio folder between the front panel 110 and rear panel 112. FIG. 5 shows a preferred binding apparatus 174 comprising a continuous metal strap having two arms 175, 176 which pass through holes in rear panel 112 before emerging from the front of the rear panel and then passing through slots 177 in removable retainer bar 178. Sheet material such as paper is received spiked on arms 175, 176 sandwiched between the retainer bar 178 and rear panel 162, as is known. Other binding apparatus and means of securing the binding apparatus to either panel 122 or 110 could be utilized.

FIG. 5 differs from FIG. 4 in a second aspect, that pocket 124 is shown in FIG. 5 in dotted lines so as to indicate that the pocket 124 need only be optionally provided with the third embodiment.

In use of the kit of FIG. 5, the front panel 110 may have printed material applied thereto by photocopying or offset printing and thereafter with release sheet removed from the adhesive strip 130, the front panel 110 may be secured to the rear panel 112 by the front panel 110 placed with the scoreline 118 aligned with the side edge 142 so that the flap portion 118 overlies a thin elongate side portion of the front panel 110 adjacent the side edge 114. The binding apparatus 174 is mechanically secured to the rear panel 112, preferably as described above, so that the sheet material may be retained thereby between the front panel 110 and the rear panel 112.

Figure 6:
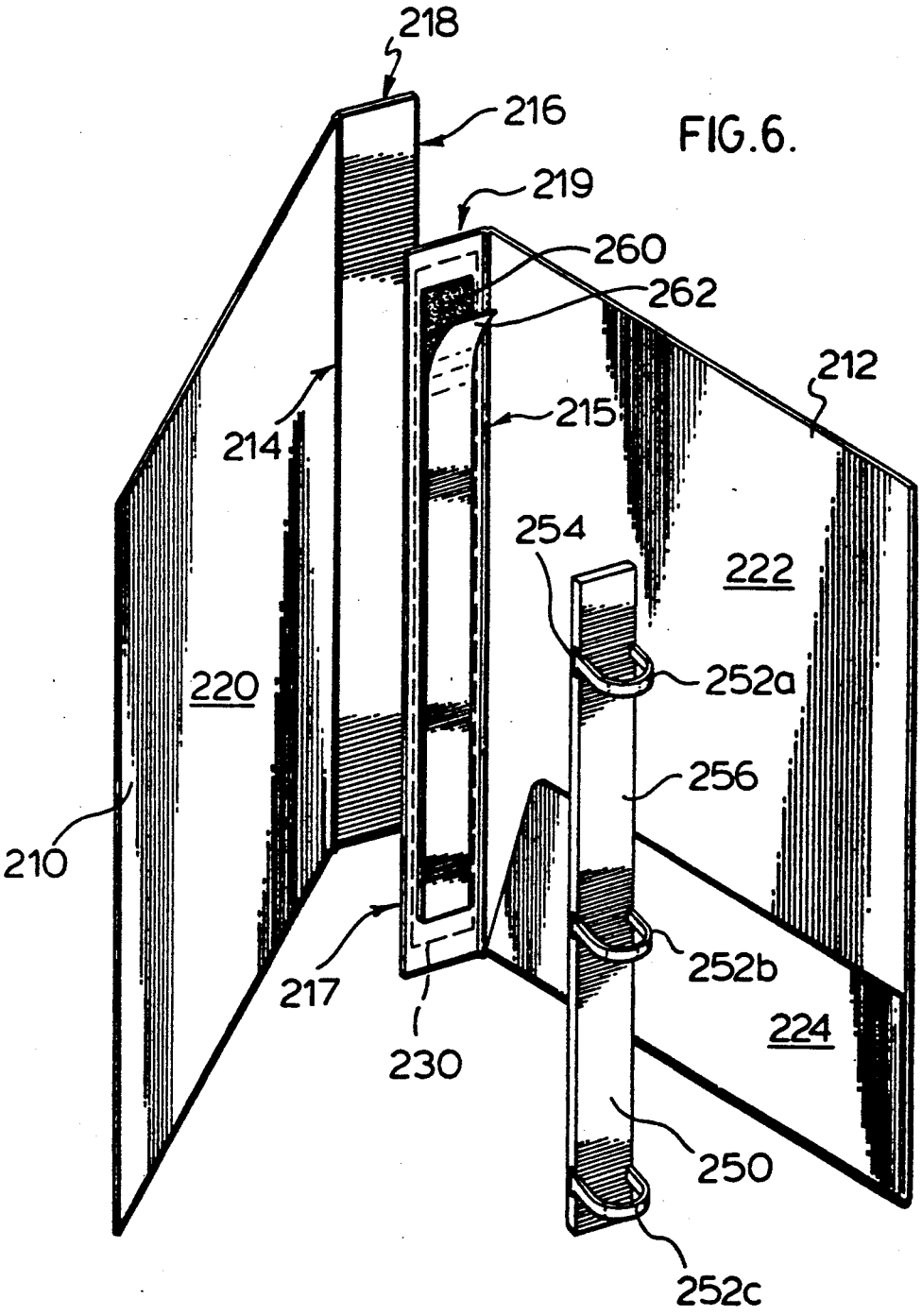
FIG. 6 is an exploded view of a fourth embodiment.

Reference is now made to FIG. 6 which shows a kit in accordance with the fourth embodiment. The kit comprises a separate front panel 210, a separate rear panel 212 and a binding apparatus 250 for releasably retaining sheet material in an assembled portfolio folder between the front panel and the rear panel.

Front panel 210 comprises a rectangular sheet of paperboard having a hinge forming scoreline 214 near one side edge 216 so as to define a thin elongate flap portion 218 between the scoreline 214 and the side edge 216, and a remaining rectangular portion 220 comprising the remainder of front panel 210 other than flap portion 218.

Rear panel 212 comprises a sheet of paperboard having a hinge forming scoreline 215 near one side edge 217 so as to define a thin elongate flap portion 219 between the scoreline 215 and the side edge 217 and a remaining rectangular portion 222 comprising the remainder of rear panel 212 other than flap portion 219. The rear panel 212 carries a pocket 224.

A first adhesive strip 230 is applied to the rear surface of flap portion 219 with adhesive strip 230 having a removable release sheet on the upper surface thereof similar to that in FIG. 3.

A second adhesive strip 260 is applied to the front surface of flap portion 219 with adhesive strip 260 having a removable release sheet 262.

The preferred embodiment of FIG. 6 shows a binding apparatus 250 having three rings **252*a*, 252*b* and 252*c*. Each ring may be opened and closed by one end 254 of each ring being releasably engaged with the base 256. The rings are adapted to retain paper sheets with complementary holes, in known manner. It is preferred the binding apparatus 250 has a flat rear surface (not shown) to facilitate adhesion to adhesive strip 260**. Other binding apparatus and means of securing the binding apparatus, are also possible.

In use of the kit of FIG. 6, the front panel 210 may have printed material applied thereto by photocopying or offset printing and thereafter with release sheet removed from the adhesive strip 230, the front panel 210 may be secured to the rear panel 212 by the front panel being placed with the scoreline 214 aligned with the side edge 217 so that the flap portion 218 overlies the flap portion 219. The joined flap portions 218 and 219 in effect provide a binder edge between the front and rear panels. With the release sheet 262 removed from the adhesive strip 260, the flat rear surface of the binding apparatus 250 may be secured to the front surface of flap portion 219 of the rear panel 212, so that sheet material may be retained thereby between the front panel 210 and the rear panel 212.

While the preferred embodiment of FIG. 6 shows the flap portion 218 substantially coextensive in size and dimensions with flap portion 219, flap portions 218 and 219 may be of different size and dimensions.

Although the first adhesive strip 230 is shown in FIG. 6 on the rear surface of flap portion 219, the adhesive strip 230 could alternately be provided on the front surface of flap portion 219, to engage the rear surface of flap portion 218. While less preferred, the adhesive strip 230 could be provided on the front surface of flap portion 218, to engage the rear surface of flap portion 219, or alternately on the rear surface of flap portion 218, to engage the front surface of flap portion 219.

While the preferred embodiment of FIG. 6 shows the second adhesive strip 260 on the front surface of flap portion 219, the adhesive strip 260 could suitably be provided elsewhere on the front surface of either front panel 210 or rear panel 212 to engage the rear surface of binding apparatus 250, or the adhesive strip 260 could be provided on the rear surface of binding apparatus 250 to engage the front surface of front panel 210 or rear panel 212.

Figure 7:
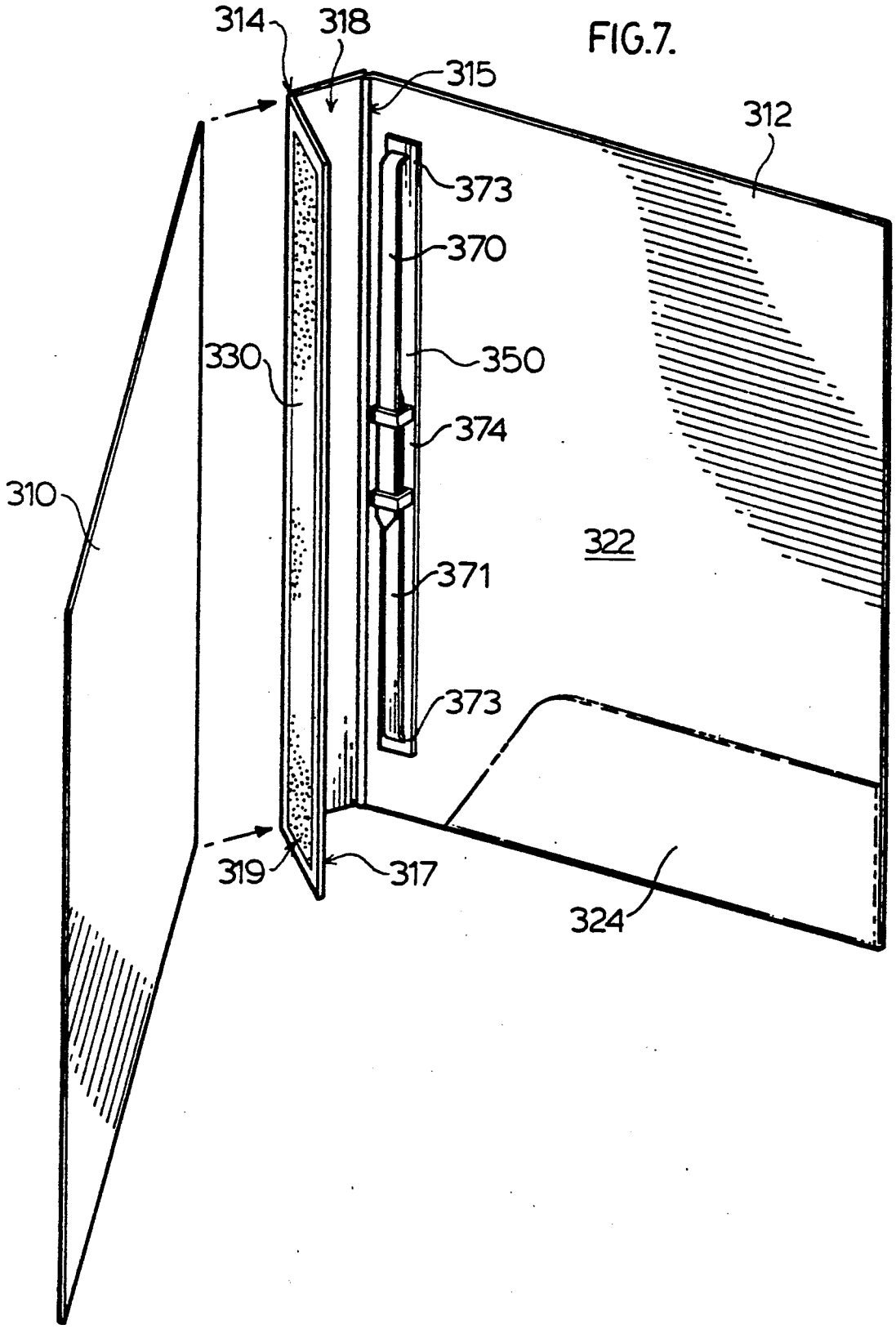
FIG. 7 is an exploded view of a fifth embodiment.

Reference is now made to FIG. 7 which shows a kit in accordance with the fifth embodiment. The kit comprises a separate front panel 310, a separate rear panel 312 and a binding apparatus 350 for releasably or permanently retaining sheet material in an assembled portfolio folder between the front panel and the rear panel.

Front panel 310 comprises a rectangular sheet of paperboard or other planar material whose front surface is adapted for photocopying or offset printing.

Rear panel 312 comprises a rectangular sheet of paperboard having two, parallel hinge forming scorelines, a first hinge forming scoreline 314 nearest one side edge 317 so as to define a thin elongate first flap portion 319 between the scoreline 314 and the side edge 317, and a second hinge forming scoreline 315 defining a thin elongate second flap portion 318 adjacent to the first flap portion 319 between the scoreline 315 and the first flap portion 319. The remainder of rear panel 312 other than the first flap portion 319 and second flap portion 318 effectively comprises a remaining rectangular portion 322. The rear panel 312 is not shown to carry a pocket, but a pocket could be provided as indicated as 324 in dotted lines.

An adhesive strip 330 is applied to the rear surface of flap portion 319 with adhesive strip 330 having a removable release sheet on the upper surface thereof similar to that in FIG. 3.

FIG. 7 shows a known binding apparatus 350 comprising a continuous metal strip with two arms 370 and 371 which pass through holes in the back panel 312 before emerging from the front of the rear panel and then passing through slots 373 in removable retainer bars 374. Paper is to be received spiked on arms 370 and 371 sandwiched between retainer bar 374 and the rear panel, as is known. Binding apparatus 350 shown in FIG. 7 is preferably mechanically secured to the folder as described above.

In use of the kit of FIG. 7, the front panel 310 may have printed material applied thereto by photocopying or offset printing and thereafter with release sheet removed from the adhesive strip 330, the front panel 310 may be secured to the rear panel 312 by the front panel being placed with the scoreline 314 aligned with the side edge 342 so that the flap portion 319 overlies a thin elongate side portion of front panel 310 adjacent side edge 342. The binding apparatus 250 is mechanically secured to the rear panel 312, so that sheet material may be retained thereby between the front panel 310 and the rear panel 312.

As with the first embodiment, the adhesive strip 330 of the fifth embodiment may be applied to either surface of flap 319 or cover 310 adjacent its side edge 342. Preferably however, strip 330 is on rear panel 312.

FIGS. 5, 6 and 7 show embodiments with binding apparatus 174, 250 and 350 to be secured to an assembled folder. The kits for these embodiments preferably are provided as three separate parts that is, with each of the binding apparatus provided separate, to be affixed to the folder during assembly. This reduces the storage space required for the kits, especially with bulkier binder assemblies as shown in FIG. 6. The kit can be provided with the binding apparatus secured to one of the panels, especially if a less bulky binder apparatus such as in FIGS. 5 and 7 are provided. Where the binding apparatus is to be provided in the kit pre-secured to one panel, other means for attachment such as rivits may be used.

The binding apparatus 174, 250 and 350 shown in FIG. 4, FIG. 5 and FIG. 6 may be secured to either the front or rear panel at any convenient location and the invention is not limited to these attachment only to the rear panel or only adjacent the binder edge.

As is to be appreciated from the drawings, with each of the embodiments, a resultant folder will have, when folded, a front panel substantially coextensive in size and dimensions with the rear panel. Thus, for example, in the first embodiment, the remaining rectangular portion is sized to be substantially identical to major portion 22. The preferred embodiment of FIGS. 1, 2, 6 and 7 show a file folder carrying a permanent pocket on the rear panel. This pocket is not necessary and an alternative pocket could be provided on either of the front or rear panels.

It is preferred that the one of the front or rear panel which is to have printed matter applied not carry an adhesive strip.

While the invention has been described with reference to preferred embodiments, it is not so limited. Many modifications and variations will now occur to persons skilled in the art. For a definition of the invention, reference is made to the appended claims.

What I claim is:

1. A kit for assembly into a portfolio folder comprising:

a separate first panel;

a separate second panel;

binding means for retaining sheet material in an assembled portfolio folder between the first panel and the second panel;

first adhesive means for securing the first panel to the second panel, second means for securing the binding means to one of the first panel and the second panel, said first panel comprising a rectangular sheet having a thin elongate first flap portion along one side edge thereof delineated from a remaining rectangular portion of the first panel by a hinge-forming first scoreline parallel to said one side edge, said second panel comprising a rectangular sheet having a thin elongate second flap portion along one side edge thereof delineated from a remaining rectangular portion of the second panel by a hinge-forming second scoreline parallel to said one side edge, said remaining rectangular portion of the second panel having dimensions substantially the same as that of said remaining rectangular portion of the first panel, said first panel adapted to be secured to said second panel by the first adhesive means with said first flap portion folded along said first scoreline, said second flap portion folded along said second scoreline, and said first flap portion overlying said second flap portion, said first adhesive means secured to a first side of one of said first flap portion and said second flap portion, said first adhesive means having a removable release sheet for removal to activate the first adhesive means for adhesion to a first side of the other of the first flap portion and the second flap portion.

2. A kit as claimed in claim 1 wherein:

one of said first or second panels has an outer surface suitable for photocopying or offset printing.

3. A kit as claimed in claim 2 wherein:

said first adhesive means is a thin strip having a layer of an adhesive on each side thereof, said first adhesive means secured against removal to said one of said first flap portion and said second flap portion by means of one of said layers of adhesive, said other layer of adhesive removably receiving said release sheet and enabled, when said release sheet is removed, to adhere to the other of said first flap portion and said second flap portion.

4. A kit as claimed in claim 3 wherein:

said first panel comprises a front panel for said folder, and has an outer surface suitable for photocopying or offset printing, said second panel comprises a rear panel for said folder, and has pocket means located on a forward facing surface thereof, said first adhesive means is located along said first side of said second flap portion, said second means for securing the binding means is located on one of the binding means and the second side of the second flap portion.

5. A kit as claimed in claim 2 wherein said binding means is separate.

6. A kit as claimed in claim 5 wherein said second means for securing the binding means comprises second adhesive means secured to one of the binding means and said first panel or said second panel, said second adhesive means having a removable release sheet for removal to activate the second adhesive means.

7. A kit as claimed in claim 6 wherein said second adhesive means is secured to one of the binding means, and a second side of one of said first flap portion or a second side of one of said second flap portion.

8. A kit as claimed in claim 4 wherein said second flap portion has dimensions substantially the same as that of the first flap portion.

9. A kit as claimed in claim 8 wherein the binding means is a plastic binder with three rings.

10. A kit for assembly into a portfolio folder comprising:

a separate first panel;

a separate second panel;

binding means for retaining sheet material in an assembled portfolio folder between the first panel and the second panel;

first adhesive means for securing the first panel to the second panel, second means for securing the binding means to one of the first panel and the second panel, said first panel comprising a rectangular sheet having a thin elongate first flap portion along one side edge thereof, a thin elongate second flap portion adjacent the first flap portion, and a remaining rectangular portion, said first flap portion delineated from the second flap portion by a hinge-forming first scoreline parallel to said one side edge, and said second flap portion delineated from the remaining rectangular portion by a hinge-forming second scoreline parallel to said one side edge, said second panel comprising a rectangular sheet of dimensions substantially the same as that of said remaining rectangular portion of the first panel, said first panel adapted to be secured by the first adhesive means to said second panel with said first flap portion folded along said first scoreline, said second flap portion folded along said second scoreline and, said first flap portion overlying a thin elongate side portion of said second panel along a side edge thereof, said first adhesive means secured to one of said first flap portion and side portion, said first adhesive means having a removable release sheet for the removal to activate the first adhesive means for adhesion to the other of said first flap portion and side portion.

11. A kit as claimed in claim 10 wherein:

said first adhesive means is a thin strip having a layer of an adhesive on each side thereof, said first adhesive means secured against removal to said one of said first flap portion and side portion by means of one of said layers of adhesive, said other layer of adhesive removably receiving said release sheet and enabled, when said release sheet is removed, to adhere to the other of said first flap portion and side portion.

12. A kit as claimed in claim 11 wherein one of said first or second panels has an outer surface suitable for photocopying or offset printing.

13. A kit as claimed in claim 12 wherein:

said second panel comprises a front panel for said folder and has an outer surface suitable for photocopying or offset printing, and said first panel comprises a rear panel for said folder with pocket means is located on a forward facing surface thereof, said first adhesive means is located along said first flap portion.

14. A kit as claimed in claim 11 wherein said binding means is separate.

15. A kit as claimed in claim 14 wherein said second means for securing the binding means comprises second adhesive means secured to one of the binding means and said first panel or said second panel, said second adhesive means having a removable release sheet for removal to activate the second adhesive means.

16. A kit as claimed in claim 15 wherein:

said second adhesive means is located along the binding means.

17. A kit as claimed in claim 16 wherein:

the binding means is a plastic binder with three rings.

18. A kit as claimed in claim 13 wherein said binding means is separate and said second means for securing the binding means comprises second adhesive means secured to said forward facing surface of said rear panel, said second adhesive means having a removable release sheet for removal to activate the second adhesive means.

19. A method of manufacture of a portfolio folder with printed material on a front surface thereof from a kit, said kit comprising:

a separate front panel;

a separate rear panel;

binding means for retaining sheet material in an assembled portfolio folder between the front panel and the rear panel;

first adhesive means for securing the front panel to the rear panel, second means for securing the binding means to one of the front panel and the rear panel, said front panel comprising a rectangular sheet having a thin elongate first flap portion along one side edge thereof delineated from a remaining rectangular portion of the front panel by a hinge-forming first scoreline parallel to said one side edge, said front panel having an outer surface suitable for applying indicia thereto by photocopying or offset printing, said rear panel comprising a rectangular sheet having a thin elongate second flap portion along one side edge thereof delineated from a remaining rectangular portion of the rear panel by a hinge-forming second scoreline parallel to said one side edge, said remaining rectangular portion of the rear panel having dimensions substantially the same as that of said remaining rectangular portion of the front panel, said first adhesive means comprising a thin strip having a layer of adhesive on each side thereof, said front panel adapted to be secured to said rear panel by the first adhesive means with said first flap portion folded along said first scoreline, said second flap portion folded along said second scoreline, and said first flap portion overlying said second flap portion, said first adhesive means secured to a first side of one of said first flap portion and said second flap portion, by means of one of said layers of adhesive, said first adhesive means having a removable release sheet for removal to activate the first adhesive means for adhesion to a first side of the other of the first flap portion and the second flap portion, said second adhesive means comprising a thin strip having a layer of adhesive on each side thereof, said second adhesive means located along the binding means, said second adhesive means secured to the binding means by means of one of said layers of adhesive, and said second adhesive means having a removable release sheet for removal to activate the adhesive means for adhesive to one of the front panel, and the rear panel, the method comprising:

(a) applying said printed material to said front surface of the front panel; and then (b) securing said front and rear panels together by detaching said removable release from the first adhesive means and securing said front panel flap portion to said rear panel flap portion with said front panel scoreline aligned with a side edge of said rear panel such that said front panel flap portion overlies said rear panel flap portion, (c) securing the binding means to the front and rear panels by detaching said removable release sheet from the second adhesive means and securing the binding means to one of the front panel and the rear panel.

20. A method of manufacture of a folder as claimed in claim 19 wherein said binding means is secured to one of a second side of said first flap portion and a second side of said second flap portion.

21. A method of manufacture of a folder as claimed in claim 20 in which said printed indicia is applied to said front surface of the front panel by passing said front panel through a photocopier or offset printer.

22. A method of manufacture of a folder as claimed in claim 21 wherein the binding means is a plastic binder with three rings.

23. A method of manufacture of a portfolio folder with printed indicia on a front surface thereof from a kit comprising:

a separate front panel;

a separate rear panel;

binding means for retaining sheet material in an assembled portfolio folder between the front panel and the rear panel;

first adhesive means for securing the front panel to the rear panel, second means for securing the binding means to one of the front panel and the rear panel, said rear panel comprising a rectangular sheet having a thin elongate first flap portion along one side edge thereof, a thin elongate second flap portion adjacent the first flap portion, and a remaining rectangular portion, said first flap portion delineated from the second flap portion by a hinge-forming first scoreline parallel to said one side edge, and said second flap portion delineated from the remaining rectangular portion by a hinge-forming second scoreline parallel to said one side edge, said front panel comprising a rectangular sheet of dimensions substantially the same as that of said remaining rectangular portion of the rear panel, said front panel having an outer surface suitable for applying indicia thereto by photocopying or offset printing, said rear panel adapted to be secured by the first adhesive means to said front panel with said first flap portion folded along said first scoreline, said second flap portion folded along said second scoreline and, said first flap portion overlying a thin elongate side portion of said front panel along a side edge thereof, said first adhesive means comprising a thin strip having a layer of adhesive on each side thereof, said first adhesive means located along said first flap portion, said first adhesive means secured to said first flap portion by means of one of said layers of adhesive, said first adhesive means having a removable release sheet for removal to activate the adhesive means for adhesion to said side portion, said second adhesive means comprising a thin strip having a layer of adhesive on each side thereof, said second adhesive means located along said second flap portion, said second adhesive means secured to said second flap portion by means of one of said layers of adhesive, and said second adhesive means having a removable release sheet for removal to activate the adhesive means for adhesive to said binding means, said method comprising:

(a) applying said indicia to said front surface of the front panel, and then (b) securing said front and rear panels together by detaching said removable release sheet from said first adhesive means and securing said first flap portion to said side portion with said first scoreline aligned with a side edge of said front panel such that said first flap portion overlaps said side portion, (c) securing the binding means to said rear panel by detaching said removable release sheet from the second adhesive means and securing the binding means to said second flap portion.

24. A method of manufacture of a folder as claimed in claim 23 in which said printed indicia is applied to said front surface of the front panel by passing said front panel through a photocopier or offset printer.

25. A method of manufacture of a folder as claimed in claim 24 wherein the binding means is a plastic binder having three rings.

26. A kit for assembly into a portfolio folder comprising:

a separate front panel having an outer surface suitable for photocopying or offset printing;

a separate rear panel;

binding means for retaining sheet material in an assembled portfolio folder between the front panel and the rear panel;

adhesive means comprising a thin strip having a layer of adhesive on each side thereof for securing the rear panel to the front panel, said rear panel comprising a rectangular sheet having a thin elongate flap portion along one side edge thereof delineated from a remaining rectangular portion of the rear panel by a hinge-forming scoreline parallel to said one side edge, said front panel comprising a rectangular sheet of dimensions substantially the same as that of said remaining rectangular portion, said rear panel adapted to be secured to said front panel with said flap portion folded along said scoreline and said flap portion overlying a thin elongate side portion of said front panel along a side edge thereof, said adhesive means secured to said flap portion by means of one of said layers of adhesive, the other layer of adhesive removably receiving a removable release sheet and enabled, when said release sheet is removed, to adhere to the side portion.

27. A kit as claimed in claim 26 wherein said binding means secured to said rear panel.

28. A kit for a portfolio folder comprising:

a separate first panel;

a separate second panel;

first adhesive means for securing the first panel to the second panel, said first panel comprising a rectangular sheet having a thin elongate flap portion along one side edge thereof delineated from a remaining rectangular portion of the first panel by a first hinge-forming scoreline parallel to said one side edge, said second panel comprising a rectangular portion of dimensions substantially the same as that of said remaining rectangular portion, one of said first and second panels having on a surface thereof means for retaining sheet material in an assembled portfolio folder between the first and the second panel, said first panel adapted to be secured to the second panel with said flap portion folded along said scoreline and said flap portion overlying a thin elongate side portion of said second panel along a side edge thereof, said first adhesive means secured to one of said flap portion and side portion, said first adhesive means having a removable release sheet for removal to activate the adhesive means for adhesion to the other of the flap portion and side portion.

29. A kit as claimed in claims 28 wherein one of said first or second panels has an outer surface suitable for photocopying or offset printing.

30. A kit as claimed in claim 29 wherein said means for retaining comprises binding means, and the kit includes second means for securing the binder means to one of the first and the second panel.

31. A kit as claimed in claim 29 wherein said second panel having a thin elongate second flap portion along said one side edge thereof delineated from said remaining rectangular portion of the second panel by a hinge-forming second scoreline parallel to said one side edge, said second flap portion carrying said side portion, said first panel adapted to be secured to said second panel by the first adhesive means with said first flap portion folded along said first scoreline, said second flap portion folded along said second scoreline, and said first flap portion overlying said side portion on said second flap portion.

32. A kit as claimed in claim 31 wherein said means for retaining comprises pocket means on a surface of one of the first and second panels.

33. A kit as claimed in claim 29 wherein said first panel having a thin elongate second flap portion adjacent the first flap portion remote from the remaining rectangular portion, said second flap portion delineated on the first flap portion by a hinge-forming second scoreline parallel to said one side edge, said side portion of said second panel carried by said second flap portion.

34. A kit as claimed in claim 33 wherein said means for retaining comprises pocket means on a surface of one of the first and second panels.

* * * * *